US011610518B1

(12) United States Patent
DiTella

(10) Patent No.: US 11,610,518 B1
(45) Date of Patent: Mar. 21, 2023

(54) SIGN COVER

(71) Applicant: Michael J DiTella, Cary, IL (US)

(72) Inventor: Michael J DiTella, Cary, IL (US)

(73) Assignee: MD&T ENGINEERING SOLUTIONS, LLC

( * ) Notice: Subject to any disclaimer, the term of this patent is extended or adjusted under 35 U.S.C. 154(b) by 0 days.

(21) Appl. No.: 17/867,953

(22) Filed: Jul. 19, 2022

Related U.S. Application Data

(60) Provisional application No. 63/203,536, filed on Jul. 27, 2021.

(51) Int. Cl.
*G09F 7/18* (2006.01)
*G09F 13/16* (2006.01)
*E01F 9/604* (2016.01)

(52) U.S. Cl.
CPC ..... *G09F 7/18* (2013.01); *E01F 9/604* (2016.02); *G09F 13/16* (2013.01); *G09F 2007/1852* (2013.01); *G09F 2007/1873* (2013.01)

(58) Field of Classification Search
CPC .... G09F 7/18; G09F 13/16; G09F 2007/1852; G09F 2007/1873; E01F 9/604
See application file for complete search history.

(56) References Cited

U.S. PATENT DOCUMENTS 6,148,555 A * 11/2000 Beauchamp ..... G09F 7/18 40/611.01
10,395,567 B2 8/2019 Harter
2015/0351479 A1* 12/2015 Cali ..... G09F 3/08 40/329

FOREIGN PATENT DOCUMENTS

AU 2008100979 A4 * 11/2008
AU 2018278931 A1 12/2018
FR 2516565 * 11/1981
JP 6412370 B2 10/2018
KR 102215008 Y1 12/2020

* cited by examiner

*Primary Examiner* — Cassandra Davis
(74) *Attorney, Agent, or Firm* — Quickpatents, LLC; Kevin Prince

(57) ABSTRACT

A sign cover includes a first portion fixed at a top side thereof with a top side of a second portion. Peripheral edges of the portions extend past a peripheral edge of a sign by a margin area when the portions are positioned over a front side and a rear side of the sign in a deployed configuration. The margin area of the portions each include a plurality of two-part mechanical fasteners. As such, in use, with the first portion and the second portion draped over the sign, the two-part mechanical fasteners hold the cover onto the sign. The first portion may include one or more transparent pockets for displaying one of several alternate signs.

19 Claims, 5 Drawing Sheets

SIGN COVER

CROSS-REFERENCE TO RELATED APPLICATIONS

This application claims the benefit of U.S. Provisional Patent Application 63/203,536, filed on Jul. 27, 1921, and is incorporated herein by reference.

STATEMENT REGARDING FEDERALLY SPONSORED RESEARCH AND DEVELOPMENT

Not Applicable.

FIELD OF THE INVENTION

This invention relates to signs, and more particularly to a temporary cover with an alternate message for an existing sign.

BACKGROUND

Construction zones for roadways often result in the need to alter or cover road signs. For example, a normal speed limit may be too fast in a construction zone. Also, other ordinances may apply such as a doubling of fines within a construction zone, and signage to that effect must be posted. Instead of removing existing signs and installing new, temporary signs, it is beneficial to temporarily cover existing signs with new messaging, provided that the cover meets the Federal Highway Administration's Manual on Uniform Traffic Control Devices (MUTCD), section 6F.07.

Several prior art products have this goal in mind, but they do not provide the flexibility of proving alternate signage easily. Further, such prior art products have attachment devices that can damage the existing sign or cause a degradation to any reflective surface of the sign.

Therefore, there is a need for a device that can be easily deployed to cover an existing sign and provide alternate, temporary messaging in place of the messaging on the existing sign. Such a needed invention would be easy to deploy, and could be made difficult to remove unless authorized by a city or county government, for example. Such a needed cover would provide for flexible messaging on both a front and a rear side of the cover, and would be made to hold a variety of signs having alternate messaging within the cover for convenience. Such a cover could be used with traffic signs or other public or private signs. The present invention accomplishes these objectives.

SUMMARY OF THE INVENTION

The present device is a cover for a sign of the type having a front side, a rear side, a peripheral edge, and a mounting pole fixed with the rear side and projecting away from a bottom side of the peripheral edge. The sign may be rectangular, diamond-shaped, circular, triangular, or other shape, as is known in the prior art. Some embodiments can accommodate signs that include two of the mounting poles.

The cover includes a first portion that has a front side, a rear side, and a peripheral edge. Preferably an indicia is included on the front side of the first portion for altering a message of the sign. For example, during construction a speed limit sign may be covered by the cover having the indica that indicates a slower speed limit.

A second portion also has a front side, a rear side, and a peripheral edge. Similar to the indicia, a second indicia may be included on the front side of the second portion for changing or adding a message to the rear side of the sign. The first portion and the second portion are adapted to match the shape of the sign and extend away from the sign. Thus for rectangular signs, the first portion and the second portion are also rectangular and slightly larger.

The first portion and the second portion are mutually fixed together at top sides of the peripheral edges, thereof, the peripheral edges, of the first portion and the second portion extend past the peripheral edge of the sign by a margin area when the first portion and the second portion are positioned over the front side and the rear side of the sign, respectively, in a deployed configuration.

The margin area of the first portion and the margin area of the second portion each include a plurality of two-part mechanical fasteners that may be selectively fastened or unfastened. Preferably the two-part mechanical fasteners include mechanical snaps, but might also include hook-and-loop type fasteners, magnetic fasteners, or other suitable two-part mechanical fasteners as is or becomes known in the art.

As such, in use, with the first portion and the second portion draped over the sign with the top sides of the peripheral edges, of the first portion and the second portion draped over a top side of the peripheral edge of the sign, the two-part mechanical fasteners are engaged to hold the first portion and the second portion onto the sign in the deployed configuration. The two-part mechanical fasteners do not contact the sign itself, thereby reducing the potential for damaging the sign, including any reflective surface, with rigid plastic or metal fasteners.

Preferably the front side of the first portion includes a first transparent pocket accessible from the rear side of the first portion through a first slot traversing the first portion. A first alternate sign is visible from the front side of the first portion when the first alternate sign is inserted through the first slot at the rear side of the first portion. In some embodiments, a second transparent pocket is included and is accessible from the rear side of the first portion through a second slot traversing the first portion. A second alternate sign is visible from the front side of the first portion when the second alternate sign is inserted through the second slot at the rear side of the first portion.

Preferably an inside pocket is fixed with either the rear side of the first portion or the rear side of the second portion. The inside pocket is adapted for holding a plurality of alternate signs hidden from view when the cover is in the deployed configuration, but accessible when attaching the cover to the sign. The alternate signs may include a variety of traffic signs and information that can be selected depending on the circumstances at any particular sign location. Such alternate signs may include reflective material or reflective tape to increase their visibility at night, for example.

In some embodiments, the bottom sides of the margin area of each of the first portion and the second portion include at least one aperture through which a locking device, such as a steel cable or the like, traverses. In such an embodiment, the locking device inhibits the first portion from being separated from the second portion, thereby locking the cover onto the sign. Such an aperture may be formed in a metal grommet having a rigid ring, for example, inhibiting unauthorized removal of the cover from the sign.

The present invention is a device that can be easily deployed to cover an existing traffic sign and provide alternate, temporary messaging in place of the messaging on the existing sign. The present cover is easy to deploy, and can be made difficult to remove unless authorized by a city or county government, for example. The present device provides for flexible messaging on both the front and the rear side of the sign, and can be made to hold a variety of signs having alternate messaging within the cover for convenience. The present invention can be used with traffic signs or other public or private signs. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 2:
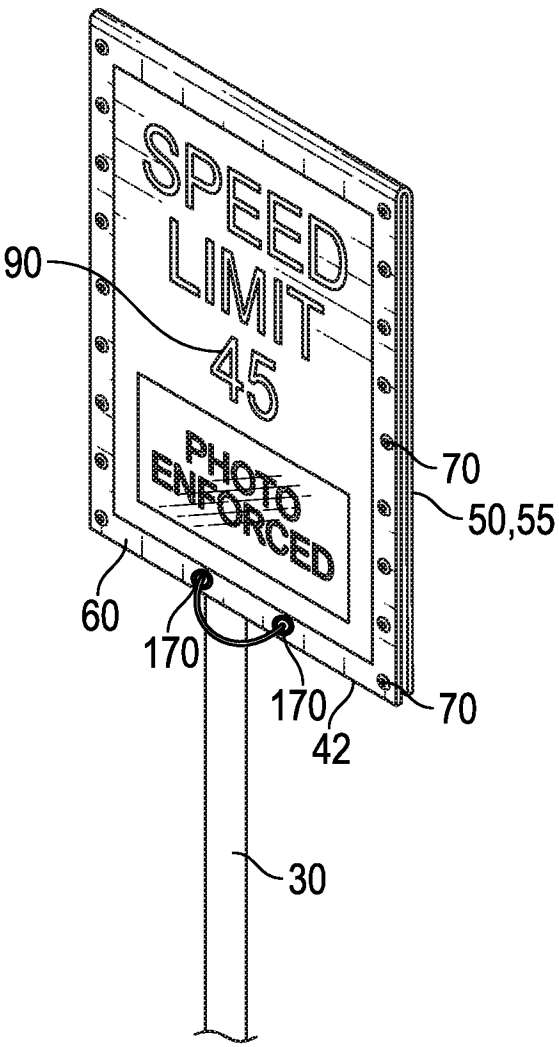
FIG. 2 is a perspective view of the invention in a deployed configuration fixed with the traffic sign.
Figure 1:
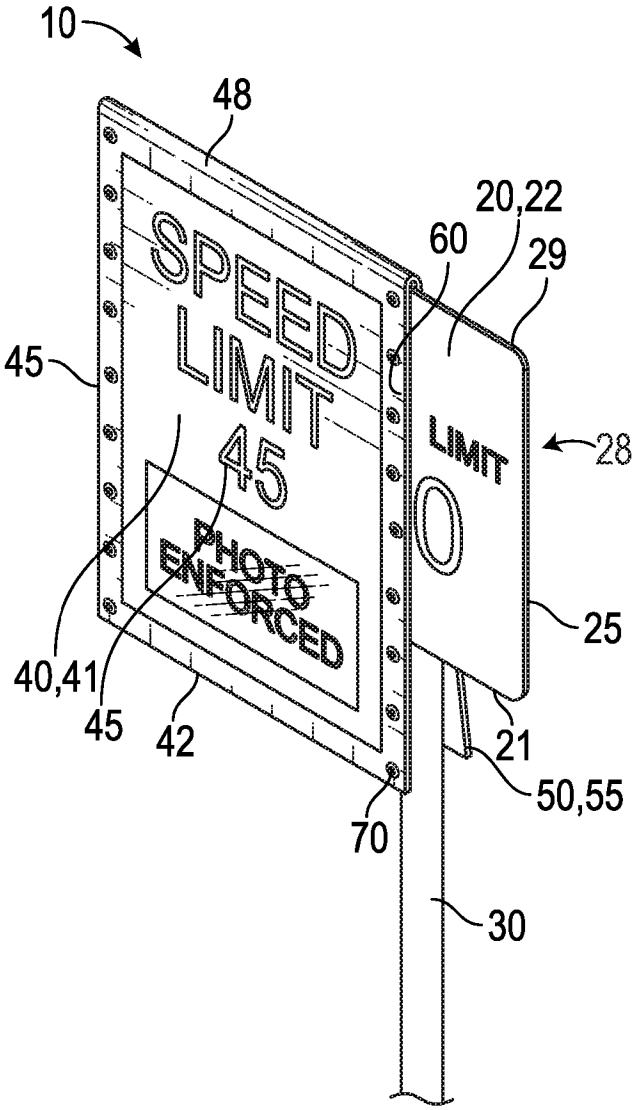
FIG. 1 is a perspective view of a cover of the invention, as being fitted over an existing traffic sign.
Figure 3:
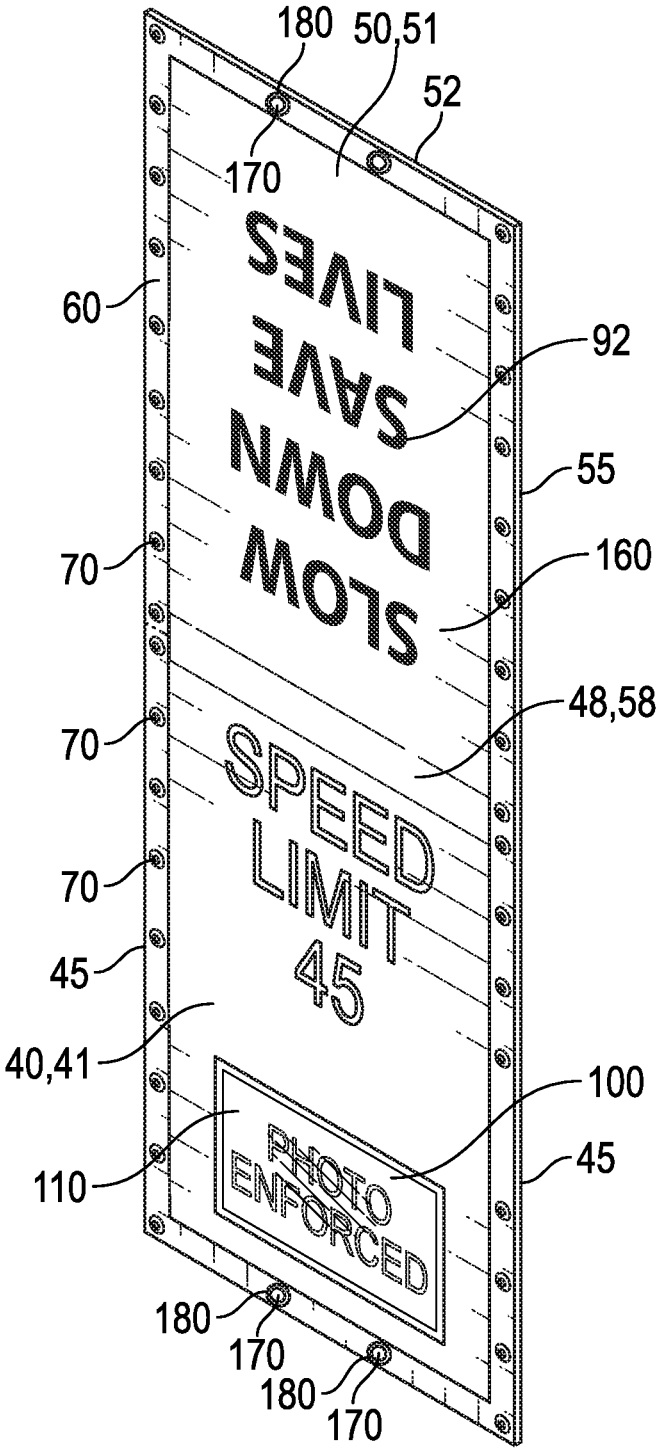
FIG. 3 is a perspective view of the cover in a flat configuration.
Figure 5:
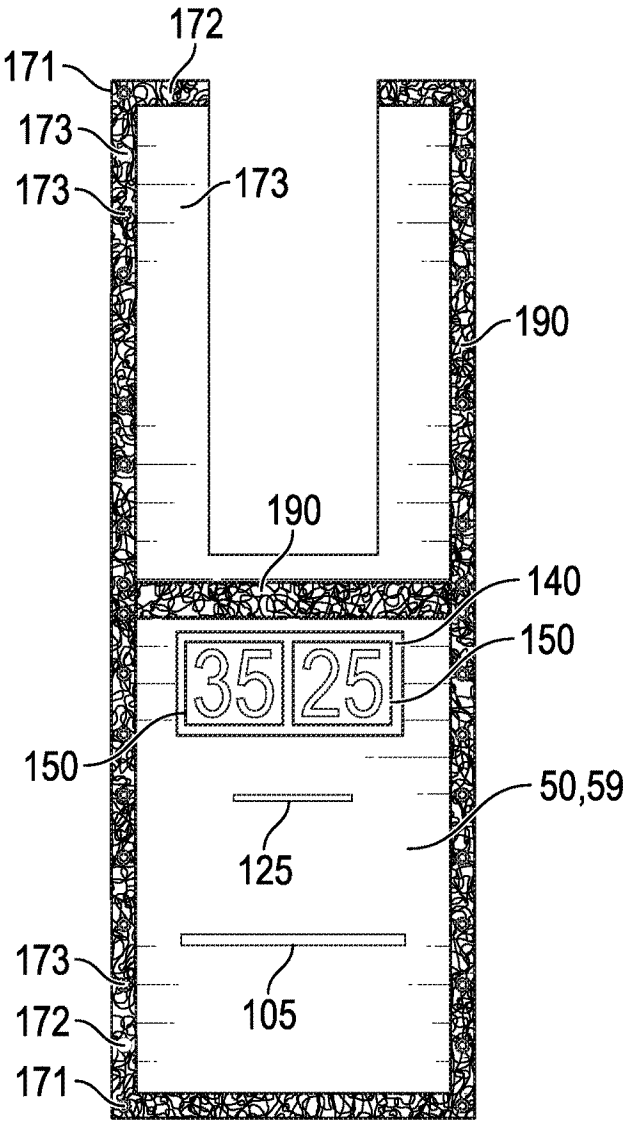
FIG. 5 is a rear elevational view of the embodiment of FIG. 4.
Figure 4:
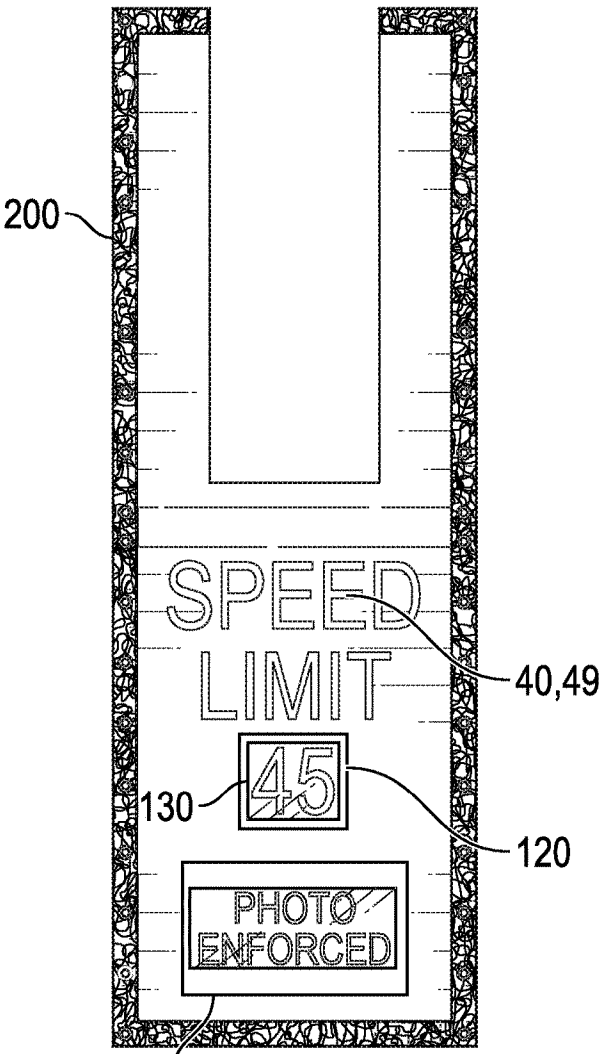
FIG. 4 is a front elevational view of an alternate embodiment of the cover in the flat configuration.
Figure 6:
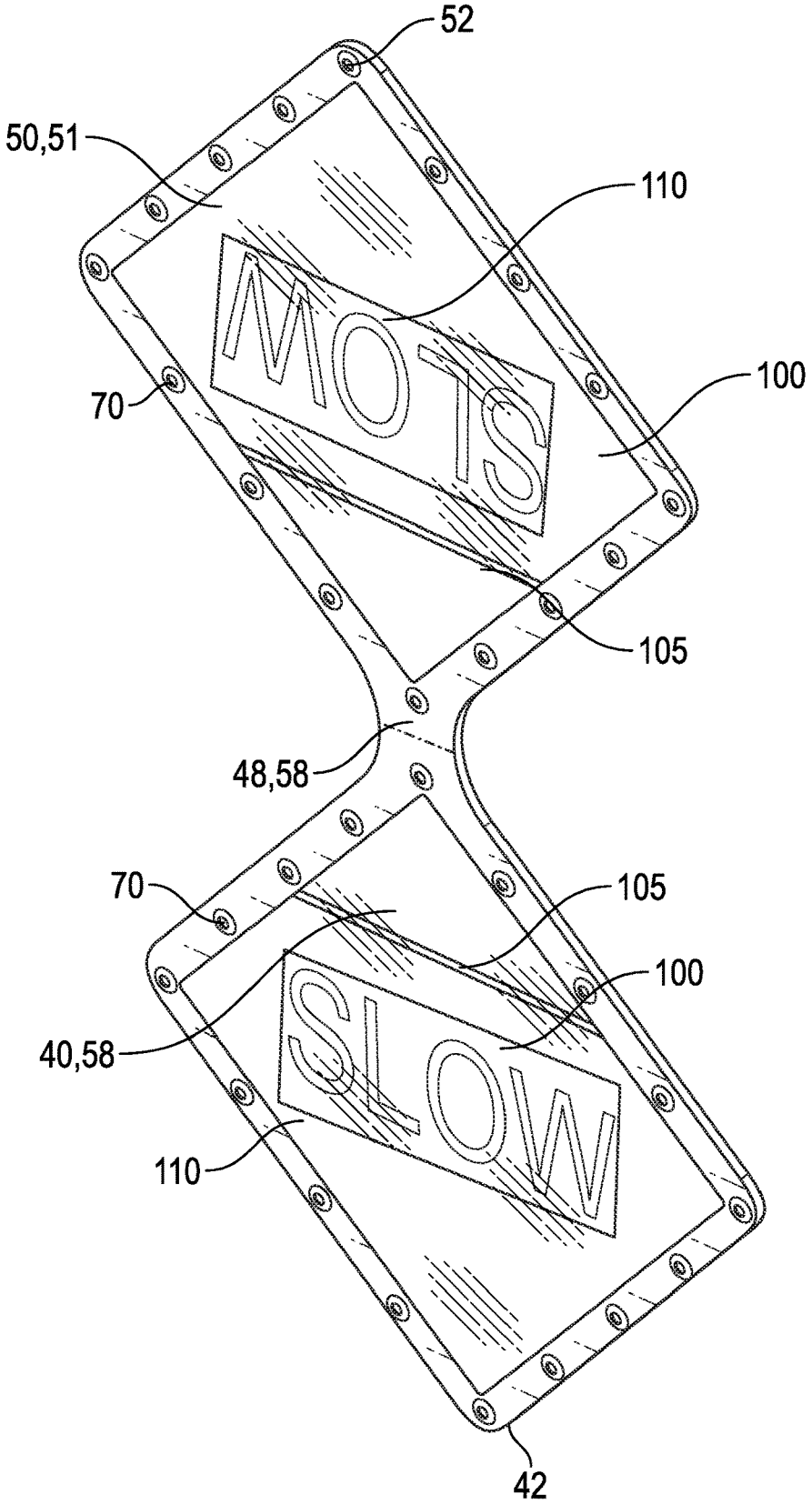
FIG. 6 is a perspective view of an alternate embodiment of the invention, illustrated in the flat configuration for covering a diamond-shaped traffic sign.
Figure 7:
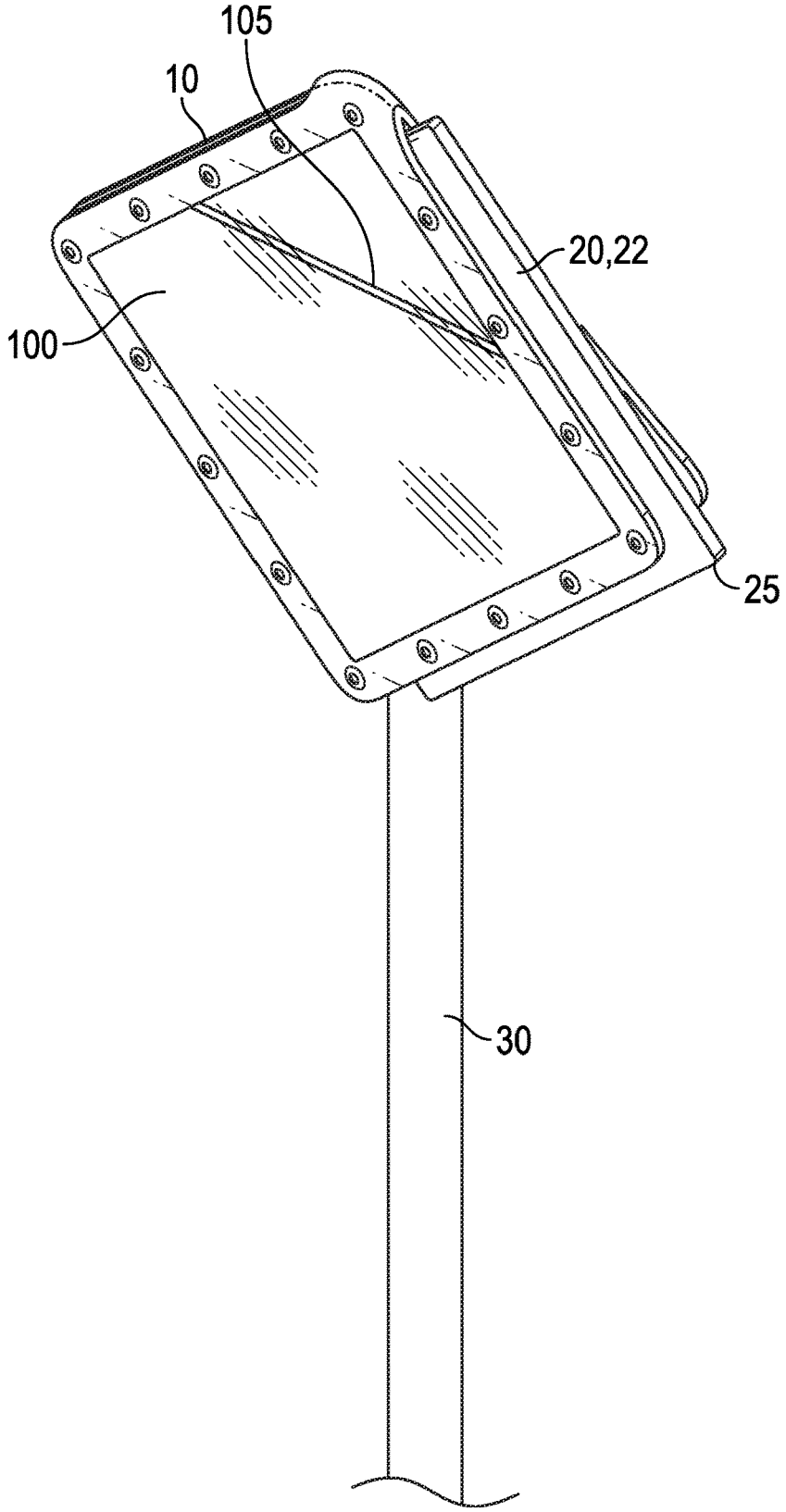
FIG. 7 is a perspective view of the embodiment of FIG. 6 as being placed over the diamond-shaped traffic sign.

FIGS. 1-3 illustrate a cover 10 for a sign 20 of the type having a front side 22, a rear side 28, a peripheral edge 25, and a mounting pole 30 fixed with the rear side 28 and projecting away from a bottom side 21 of the peripheral edge 25. The sign 20 may be rectangular (FIGS. 1-5), diamond-shaped (FIGS. 6 and 7), or other shape, as is known in the prior art.

The cover 10 includes a first portion 40 that has a front side 41, a rear side 49, and a peripheral edge 45. Preferably a first indicia 90 is included on the front side 41 of the first portion 40 for altering a message of the sign 20. For example, during construction a speed limit sign 20 may be covered by the cover 10 having the first indica 90 that indicates a slower speed limit.

A second portion 50 also has a front side 51, a rear side 59, and a peripheral edge 55. Similar to the first indicia 90, a second indicia 92 (FIG. 3) may be included on the front side 51 of the second portion 50 for changing or adding a message to the rear side 28 of the sign 20. The first portion 40 and the second portion 50 are adapted to match and extend away from the shape of the sign 20. Thus for rectangular signs 20, the first portion 40 and the second portion 50 are also preferably rectangular.

The first portion 40 and the second portion 50 are mutually fixed together at top sides 48,58 of the peripheral edges 45,55 thereof, the peripheral edges 45,55 of the first portion and the second portion 50 extend past the peripheral edge 25 of the sign 20 by a margin area 60 when the first portion 40 and the second portion 50 are positioned over the front side 22 and the rear side 28 of the sign 20, respectively, in a deployed configuration 80.

Preferably the cover 10 is made from a single flexible web 160 (FIG. 3) wherein the first portion 40 and the second portion 50 are integrally formed, with the top sides 48,58 of each section 40,50 being contiguous. Such a flexible web 160 may be a vinyl or other plastic material, an elastic or stretchable elastomeric material, a fabric material, or a rigid plastic sheet material that includes a living hinge at the top sides 48,58 of the first portion and the second portion 50. Alternately the first portion 40 and the second portion 50 are separate and assembled in the field during deployment with zip ties, straps, or the like.

Preferably the second section includes a pole cutout 210 (FIGS. 4 and 5) for accommodating the mounting pole 30. In situations where the mounting pole 30 projects away from a top side or lateral side edges of the sign (not shown), the cover 10 can be rotated accordingly. Some embodiments can accommodate signs 20 that include two of the mounting poles 30, for example by not fastening all of the two-part mechanical fasteners 70 on the bottom sides 42,52 of the portions 40,50.

The margin area 60 of the first portion 40 and the margin area 60 of the second portion 50 each include a plurality of two-part mechanical fasteners 70 that may be selectively fastened or unfastened. Preferably the two-part mechanical fasteners 70 include mechanical snaps 71, but might also include hook-and-loop type fasteners 72, magnetic fasteners 73, or other suitable two-part mechanical fasteners 70 as is or becomes known in the art. In some embodiments the two-part mechanical fasteners 70 include a locking mechanism (not shown) that prevents the unfastening of the two-part mechanical fasteners 70 without a special key, magnet, screw bit, or the like. The two-part mechanical fasteners 70 do not contact the sign 20 itself, thereby reducing the potential for damaging the sign 20, including any reflective surface thereof, with rigid plastic or metal fasteners 70.

As such, in use, with the first portion 40 and the second portion 50 draped over the sign with the top sides 48,58 of the peripheral edges 45,55 of the first portion 40 and the second portion 50 draped over a top side 29 of the peripheral edge 25 of the sign 20, the two-part mechanical fasteners 70 are engaged to hold the first portion 40 and the second portion 50 onto the sign 20 in the deployed configuration.

Preferably the front side 41 of the first portion 40 includes a first transparent pocket 100 accessible only from the rear side 49 of the first portion 40 through a first slot 105 (FIGS. 4-6) traversing the first portion 40. A first alternate sign 110 is visible from the front side of the first portion 40 when the first alternate sign 110 is inserted through the first slot at the rear side 49 of the first portion 40. Once the cover 10 is in the deployed configuration 80, the first alternate sign 110 is not accessible from the front side 41 of the first portion 40, inhibiting tampering of the first alternate sign 110.

In some embodiments, a second transparent pocket 120 (FIGS. 4-6) is included and is accessible from the rear side 49 of the first portion 40 through a second slot 125 traversing the first portion 40. A second alternate sign 120 is visible from the front side of the first portion 40 when the second alternate sign 120 is inserted through the second slot 125 at the rear side 49 of the first portion 40.

Preferably an inside pocket 140 (FIG. 5) is fixed with either the rear side 49 of the first portion 40 or the rear side 59 of the second portion 50. The inside pocket 40 is adapted for holding a plurality of alternate signs 150 hidden from view when the cover 10 is in the deployed configuration 80, but accessible when attaching the cover 10 to the sign 20. The alternate signs 150 may include a variety of traffic signs and information that can be selected depending on the circumstances at any particular sign location. Such alternate signs 150 may include reflective material or reflective tape 200 to increase their visibility at night, for example.

In some embodiments, the bottom sides 42,52 of the margin area 60 of each of the first portion 40 and the second portion 50 include at least one aperture 170 (FIGS. 2 and 3) through which a locking device 172, such as a steel cable or the like, traverses. In such an embodiment, the locking device 172 inhibits the first portion 40 from being separated from the second portion 50, thereby locking the cover 10 onto the sign 20. Such an aperture 170 may be formed in a metal grommet having a rigid ring 180, for example, inhibiting unauthorized removal of the cover 10 from the sign 20.

In some embodiments, the rear sides 49,59 of each of the first portion 40 and the second portion 50 include a puncture-resistant layer 190 (FIG. 5) fixed at the top sides 48,58 of their peripheral edges 45,55, such that the top side 29 of the sign 20 is inhibited from damaging the cover 10. The puncture-resistant layer 190 may be similarly fixed to the rear sides 49,59 of each of the first portion 40 and the second portion 50 about the margin area 60. The front sides 41,51 of each of the first portion 40 and the second portion 50 may also include the reflective tape 200 (FIG. 4) and/or LED lighting (not shown) at the margin area 60 for increasing the visibility of the cover 10 at night, for example. Alternately, the front side 41 of the front portion 40, and by extension the front side 51 of the second portion 50, may be made with a retroreflective material.

While a particular form of the invention has been illustrated and described, it will be apparent that various modifications can be made without departing from the spirit and scope of the invention. For example, only rectangular and diamond-shaped signs 20 are illustrated in the figures, but other shapes such as circular or triangular may also be accommodated by the disclosed invention. Likewise, it is understood that a rectangular sign cover 10 can be installed over a diamond sign 20, for example, if it fits and if the installer is able to make the cover 10 stable on the sign 20. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A cover for a sign of the type having a front side, a rear side, a peripheral edge, and a mounting pole fixed with the rear side and projecting away from a bottom side of the peripheral edge, the cover comprising:

a first portion having a front side, a rear side, and a peripheral edge; and a second portion having a front side, a rear side, and a peripheral edge;

the first portion and the second portion mutually fixed together at top sides of the peripheral edges thereof, the peripheral edges of the first portion and the peripheral edges of the second portion both adapted to extend past the peripheral edge of the sign by a margin area when the cover is in a deployed configuration, wherein the top side of the peripheral edges of the first portion and the top side of the peripheral edges of the second portion are draped over a top side of the sign, the first portion covering the front side of the sign and the second portion covering the rear side of the sign;

the margin areas including a plurality of two-part mechanical fasteners that may be selectively fastened or unfastened;

wherein the front side of the first portion includes a first transparent pocket accessible from the rear side of the first portion through a first slot traversing the first portion, a first alternate sign being visible from the front side of the first portion when the first alternate sign is inserted through the first slot at the rear side of the first portion;

whereby with the cover in the deployed configuration, the two-part mechanical fasteners are engaged to hold the first portion and the second portion to each other and onto the sign.

2. The cover of claim 1 wherein the front side of the first portion includes a first indicia.

3. The cover of claim 2 wherein the front side of the second portion includes a second indicia.

4. The cover of claim 1 wherein the front side of the first portion includes a second transparent pocket accessible from the rear side of the first portion through a second slot traversing the first portion, a second alternate sign being visible from the front side of the first portion when the second alternate sign is inserted through the second slot at the rear side of the first portion.

5. The cover of claim 1 wherein an inside pocket is fixed to either the rear side of the first portion or a rear side of the second portion, the inside pocket adapted for holding a plurality of alternate signs hidden from view when the cover is in the deployed configuration.

6. The cover of claim 1 wherein the sign is generally rectangular, and wherein the first section and the second section are also generally rectangular to match.

7. The cover of claim 1 wherein the sign is generally diamond shaped, and wherein the first section and the second section are also generally diamond shaped to match.

8. The cover of claim 1 wherein the first section and the second section are integrally formed from a flexible web.

9. The cover of claim 1 wherein the two-part mechanical fasteners include mechanical snaps.

10. The cover of claim 1 wherein the two-part mechanical fasteners include hook-and-loop type fasteners.

11. The cover of claim 1 wherein the two-part mechanical fasteners include magnets.

12. The cover of claim 1 wherein a bottom sides of the margin area of each of the first portion and the second portion include an aperture through which a locking device traverses, the locking device preventing the first portion from being separated from the second portion, thereby locking the cover onto the sign.

13. The cover of claim 12 wherein each aperture is reinforced by a rigid ring therearound.

14. The cover of claim 1 wherein the front side of the first portion includes reflective tape.

15. The cover of claim 14 wherein the front side of the second portion includes the reflective tape.

16. The cover of claim 1 wherein at least the front side of the first portion includes a retroreflective web material.

17. A cover for a sign of the type having a front side, a rear side, a peripheral edge, and a mounting pole fixed with the rear side and projecting away from a bottom side of the peripheral edge, the cover comprising:

a first portion having a front side, a rear side, and a peripheral edge; and a second portion having a front side, a rear side, and a peripheral edge;

the first portion and the second portion mutually fixed together at top sides of the peripheral edges thereof, the peripheral edges of the first portion and the peripheral edges of the second portion both adapted to extend past the peripheral edge of the sign by a margin area when the cover is in a deployed configuration, wherein the top side of the peripheral edges of the first portion and the top side of the peripheral edges of the second portion are draped over a top side of the sign, the first portion covering the front side of the sign and the second portion covering the rear side of the sign;

the margin areas including a plurality of two-part mechanical fasteners that may be selectively fastened or unfastened;

wherein the rear sides of each of the first portion and the second portion include a puncture-resistant layer fixed at the top sides of their peripheral edges, whereby the top side of the sign is inhibited from damaging the cover;

whereby with the cover in the deployed configuration, the two-part mechanical fasteners are engaged to hold the first portion and the second portion to each other and onto the sign.

18. A cover for a sign of the type having a front side, a rear side, a peripheral edge, and a mounting pole fixed with the rear side and projecting away from a bottom side of the peripheral edge, the cover comprising:

a first portion having a front side, a rear side, and a peripheral edge; and a second portion having a front side, a rear side, and a peripheral edge;

the first portion and the second portion mutually fixed together at top sides of the peripheral edges thereof, the peripheral edges of the first portion and the peripheral edges of the second portion both adapted to extend past the peripheral edge of the sign by a margin area when the cover is in a deployed configuration, wherein the top side of the peripheral edges of the first portion and the top side of the peripheral edges of the second portion are draped over a top side of the sign, the first portion covering the front side of the sign and the second portion covering the rear side of the sign;

the margin areas including a plurality of two-part mechanical fasteners that may be selectively fastened or unfastened;

wherein the rear sides of each of the first portion and the second portion include a puncture-resistant layer fixed about the margin area thereof;

whereby with the cover in the deployed configuration, the two-part mechanical fasteners are engaged to hold the first portion and the second portion to each other and onto the sign.

19. A cover for a sign of the type having a front side, a rear side, a peripheral edge, and a mounting pole fixed with the rear side and projecting away from a bottom side of the peripheral edge, the cover comprising:

a first portion having a front side, a rear side, and a peripheral edge; and a second portion having a front side, a rear side, and a peripheral edge;

the first portion and the second portion mutually fixed together at top sides of the peripheral edges thereof, the peripheral edges of the first portion and the peripheral edges of the second portion both adapted to extend past the peripheral edge of the sign by a margin area when the cover is in a deployed configuration, wherein the top side of the peripheral edges of the first portion and the top side of the peripheral edges of the second portion are draped over a top side of the sign, the first portion covering the front side of the sign and the second portion covering the rear side of the sign;

the margin areas including a plurality of two-part mechanical fasteners that may be selectively fastened or unfastened;

wherein the second portion includes a mounting pole cut-out adapted to fit around the mounting pole;

whereby with the cover in the deployed configuration, the two-part mechanical fasteners are engaged to hold the first portion and the second portion to each other and onto the sign.

* * * * *